US006668765B2

(12) United States Patent
Zlotek

(10) Patent No.: US 6,668,765 B2
(45) Date of Patent: Dec. 30, 2003

(54) LIQUID COOLED POWER STEERING PUMP

(75) Inventor: Richard A Zlotek, Lapeer, MI (US)

(73) Assignee: DaimlerChrysler Corporation, Auburn Hills, MI (US)

( * ) Notice: Subject to any disclaimer, the term of this patent is extended or adjusted under 35 U.S.C. 154(b) by 0 days.

(21) Appl. No.: 10/036,299

(22) Filed: Dec. 26, 2001

(65) Prior Publication Data

US 2003/0116104 A1 Jun. 26, 2003

(51) Int. Cl.[7] ..... F01P 1/06
(52) U.S. Cl. ..... 123/41.31
(58) Field of Search ..... 415/176, 177, 415/178; 417/199.1, 201, 313; 123/41.31, 41.44, 196 AB, 198 C, 198 R, 41.57, 41.29

(56) References Cited

U.S. PATENT DOCUMENTS 5,095,855 A * 3/1992 Fukuda et al. ..... 123/41.44
5,501,184 A 3/1996 Engelen et al.
5,794,920 A * 8/1998 Kronberger ..... 254/361
5,839,398 A 11/1998 Hamilton
6,328,534 B1 * 12/2001 Keyes et al. ..... 417/201
6,478,559 B2 * 11/2002 Bishop et al. ..... 418/133

FOREIGN PATENT DOCUMENTS

DE 4116192 A1 * 11/1992 ..... B60T/13/12

* cited by examiner

*Primary Examiner*—Henry C. Yuen
*Assistant Examiner*—Hyder Ali
(74) *Attorney, Agent, or Firm*—Thomas A. Jurecko

(57) ABSTRACT

A motor vehicle power steering pump using engine coolant to cool the pump is provided. Engine coolant from the engine coolant system is partially diverted to a cooling jacket cast integrally with the housing for the pump, wherein the engine coolant flows to remove heat generated by the pump. The cooling jacket includes an inlet port and an outlet port, wherein engine coolant enters and exits before return to the engine coolant system. The cooling jacket is provided about a periphery of the pump housing and is disposed partially adjacent the pump housing. The coolant jacket, a gasket, and an end cover are assembled to provide the enclosed coolant flow path through the coolant jacket.

8 Claims, 4 Drawing Sheets

LIQUID COOLED POWER STEERING PUMP

FIELD OF THE INVENTION

The present invention relates to power steering pumps for motor vehicles and, more specifically, to a motor vehicle power steering pump having a cooling jacket cooled by a liquid cooling system of the vehicle.

BACKGROUND OF THE INVENTION

Conventional internal combustion engines produce heat that must be removed from the engine. Most vehicles employing an internal combustion engine also employ a liquid cooling system to remove the heat generated by the engine. The liquid used for this purpose is generally a mixture of water with ethylene glycol added to inhibit corrosion in the system and permit operation at cold temperatures. A typical cooling system includes tubing or hoses to transfer the liquid coolant from the engine to a radiator or heat exchanger, wherein the liquid is cooled by air flow through the radiator, the cooled liquid exiting the radiator is then pumped by a separate fluid pump through tubing or hoses in a return path to the engine.

Motor vehicles also commonly employ power steering assist systems in order to reduce the amount of effort required to steer the vehicle. These systems generally employ a power steering pump fluid, such as a hydraulic fluid, which is pumped within a steering control unit. The pumping pressure is used to assist steering effort of the vehicle. In use, the power steering pump generates heat, which is normally removed by another heat exchange system. Known systems to remove heat from the power steering pump use an air-cooled heat exchanger wherein the fluid from the hydraulic pump system is transferred and air-cooled in the heat exchanger in a manner similar to the liquid cooling that takes place in a radiator for the engine coolant.

Vehicle operating conditions can effect the flow rate of cooling air to the power steering system heat exchanger, which then affects the heat exchange rate and therefore the performance of the overall system. A vehicle is often required to travel in a stop-and-go fashion, particularly when commuting in heavily populated areas. In warm weather, heat generated by the power steering pump is continuously transferred to the heat exchanger. When the vehicle is stopped for extended periods of time, however, the heat exchanger does not receive sufficient air flow to cool the power steering fluid. During cold weather, an opposite effect occurs. Cold temperatures increase the viscosity of the power steering pump fluid. As the temperature of the air flow through the heat exchanger decreases, the power steering pump fluid will become increasingly viscous, thereby reducing its lubricating capability. Increased wear on the pump's moving components can result from the flow of higher viscosity fluid through the pump. Also, during low temperature operation, a high frequency noise is often generated by the power steering pump. This noise is also a result of increased power steering fluid viscosity.

In addition to the above temperature considerations, the power steering pump and its heat exchanger provide both arrangement and cost difficulties to overcome. As a separate component, the heat exchanger must be mounted and provided with fluid hoses and/or tubing for transfer between the pump and the heat exchanger. Arrangement of components on many motor vehicles is constrained; therefore, the requirement to provide an individually mounted heat exchanger as a separate component to provide cooling for the power steering pump increases the overall cost and weight of the vehicle.

Systems that employ the engine coolant from the motor vehicle to cool the power steering fluid for the power steering system are known. Such systems transfer the power steering fluid from the pump to a heat exchanger, wherein the engine coolant from the motor vehicle cools the power steering fluid flowing there through. Also known are systems that employ the engine coolant itself as the fluid to actuate the power steering pump unit. Coolant actuating systems require a pressure control sub-system, because the hydraulic power steering system operates at a higher pressure than the pressure of the engine coolant system. The disadvantage of known engine coolant systems employed to separately cool the fluid from the power steering system is that a separate heat exchanger is employed. Engine coolant provided to operate the power steering pump can also cool the pump; however, the disadvantage of employing engine coolant for this purpose is that pressure control components are added to increase the normally lower engine coolant pressure, which increase the system weight, cost and arrangement complexity.

SUMMARY OF THE INVENTION

In accordance with one embodiment of the present invention, a power steering pump is provided which comprises a power steering pump housing having an open end and an integral cooling jacket for circulating a coolant to cool the pump housing. An end cover sealably covers the housing open end.

In another embodiment of the present invention, a motor vehicle cooling system is provided. The system comprises an engine and a radiator in fluid communication with the engine via a coolant return line. The radiator cools an engine coolant prior to return of the coolant to the engine through the coolant return line. A fluid pump in fluid communication with the radiator pumps the engine coolant from the radiator to the engine. A power steering pump includes a pump housing and a cooling jacket. The cooling jacket is disposed about the pump housing and is connected with the coolant return line to provide engine coolant to the power steering pump, wherein the coolant flows between the cooling jacket and the pump housing to cool the power steering pump.

In a further embodiment of the present invention, a method is provided to cool a power steering pump of a motor vehicle. The method comprises the steps of pumping an engine coolant through a coolant system of a motor vehicle, disposing a power steering pump having a pump housing in fluid communication with the coolant system, arranging a cooling jacket about the pump housing, and circulating the engine coolant between the cooling jacket and the pump housing to cool the power steering pump.

It is desirable to provide the engine coolant to the hydraulic power steering pump after the coolant has exited the heat exchanger or radiator of the motor vehicle. A connection is provided downstream of the radiator to supply the inlet flow to the cooling jacket. Engine coolant flow enters an inlet port of the cooling jacket, flows through the jacket, and exits through an exit port where the coolant is returned to the engine coolant system.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
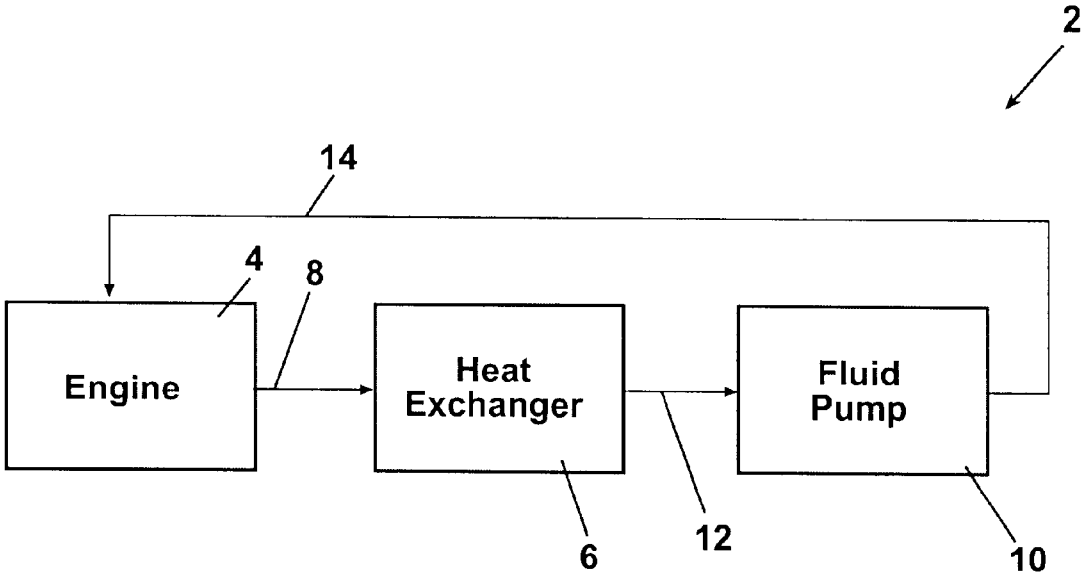
Fig. 1 (Prior Art)
FIG. 1 is a block diagram of a known motor vehicle cooling system flow path.

Referring to FIG. 1, a block diagram of a coolant flow path for a known motor vehicle coolant system is shown. Fluid cooling system 2 provides an engine 4 in fluid communication with a heat exchanger 6 through heat exchanger inlet line 8. The output of heat exchanger 6 flows to a fluid pump 10 through fluid pump inlet line 12. Engine coolant heated within engine 4 is subsequently cooled by heat exchanger 6 prior to pumping by fluid pump 10 of the engine coolant back to the engine. The discharge from fluid pump 10 is directed back to engine 4 via coolant return line 14.

Figure 2:
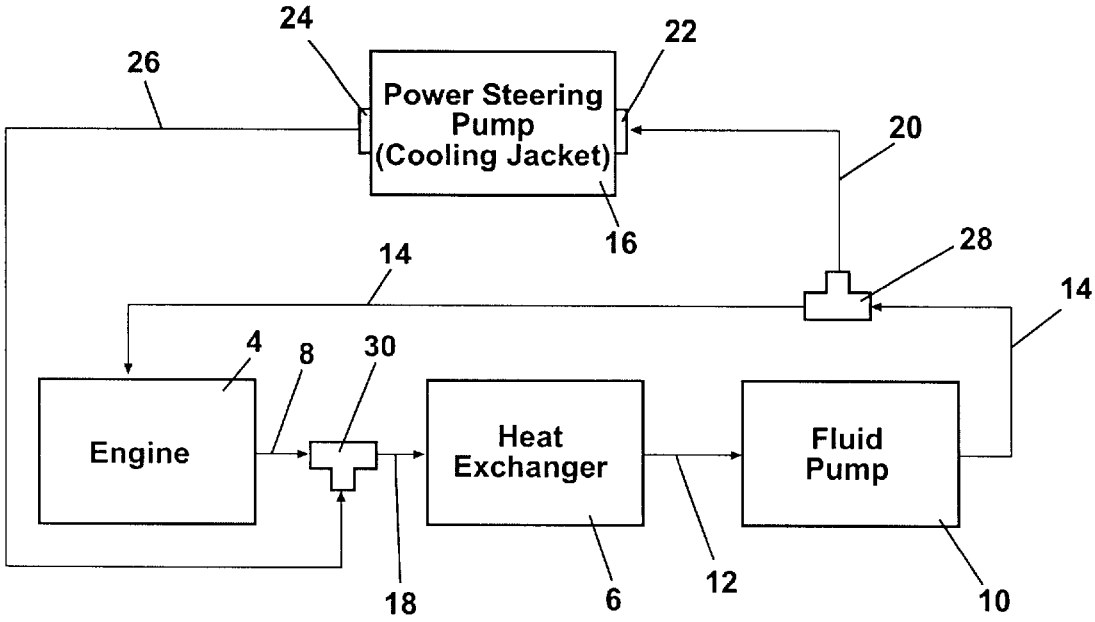
FIG. 2 is a block diagram of a motor vehicle cooling system according to the present invention employing a flow-path for engine coolant to cool the power steering pump.

Referring to FIG. 2, a block diagram is provided for a fluid system according to the invention to provide a coolant flow path for a power steering pump. A power steering pump 16 is disposed in parallel with coolant return line 14 and engine 4. Coolant returning to engine 4 via coolant return line 14 splits in part through power steering pump 16 and re-combines with the engine output flow to heat exchanger 6 in combined heat exchanger inlet line 18 down-stream of the engine. A portion of the engine coolant is therefore diverted via power steering pump supply line 20 to inlet port 22 of power steering pump 16. This portion of engine coolant flows through a cooling jacket of power steering pump 16 and exits the pump at outlet port 24. From outlet port 24 the portion of coolant flows through power steering pump return line 26 to combined coolant return line 18.

Coolant return line 14 and combined heat exchanger inlet line 18 are normally larger hose sizes than that required for the partial flow through power steering pump 16. Fittings are therefore provided to connect the supply and return lines for the power steering pump into coolant return line 14 and heat exchanger inlet line 8. A supply fitting 28 and a return fitting 30 are shown. Additional fittings (not shown) can be employed in the power steering pump supply line 20 and power steering return line 26, respectively, as needed to support the arrangement and location of power steering pump 16. Exemplary supply fitting 28 and return fitting 30 are shown as tees. In a preferred embodiment, the fittings 28, 30 are reducing tees wherein the main port through the tee body will be the larger size required for the engine coolant flow and the branch from the tees supports the supply and return for power steering pump 16. Fittings 28 and 30 may also be provided as elbows, flow control devices, reducers and enlargers to suit the arrangement.

Figure 3:
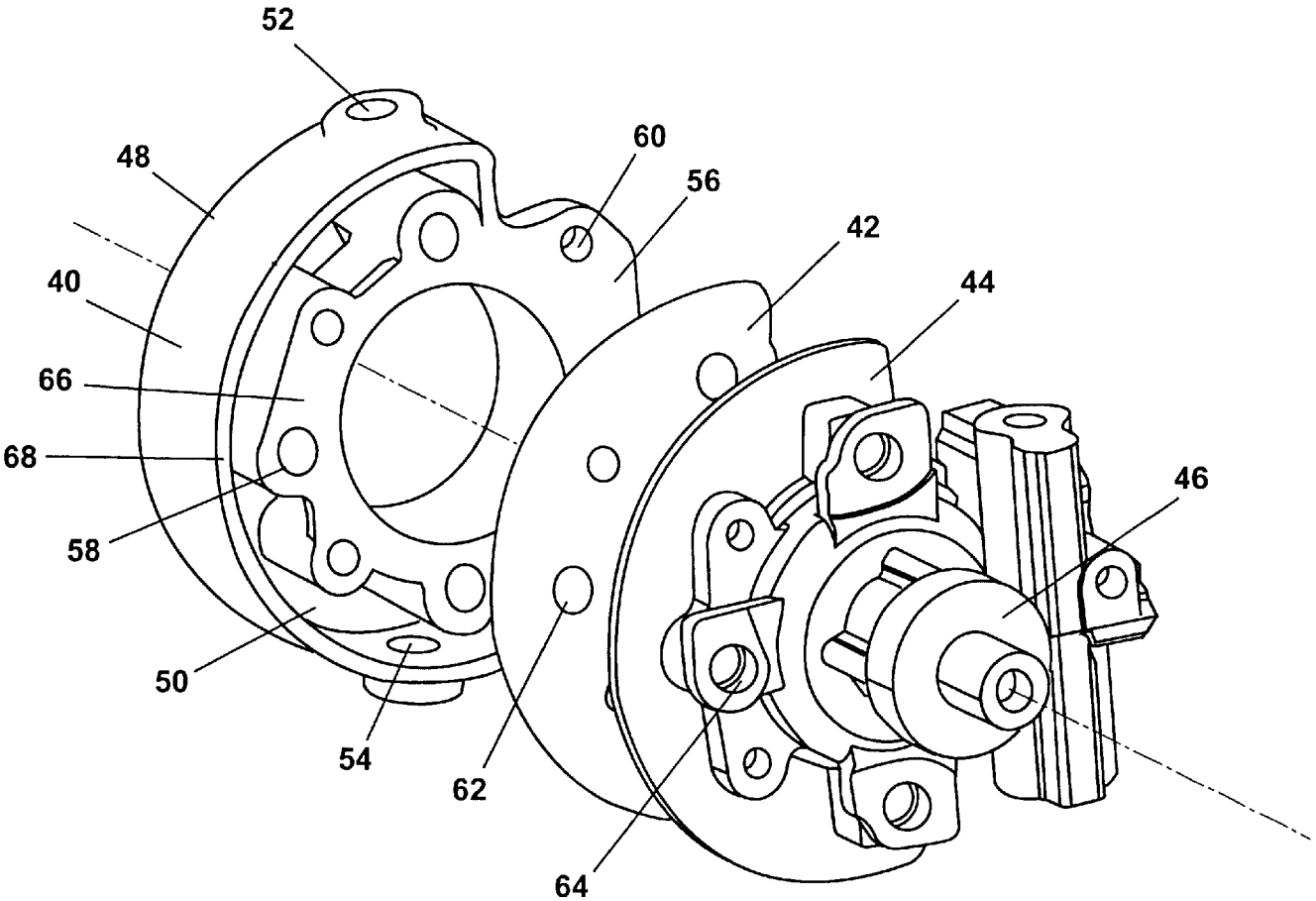
FIG. 3 is a perspective view of the assembly of the jacketed power steering pump unit of the present invention including the gasket and end piece required to seal the jacket and allow engine coolant flow within the cooling jacket.

Referring now to FIG. 3, a perspective assembly drawing of a power steering pump of the present invention is shown. The power steering pump comprises pump housing 40, gasket 42, and end cover 44. Pump unit 46 is shown attached to end cover 44. A coolant jacket 48 is cast with the pump housing 40. The configuration shown in FIG. 3 for coolant jacket 48 provides a coolant jacket around a portion of the periphery of pump housing 40. Coolant jacket 48 can alternatively comprise a jacket surrounding the pump housing 40. Coolant jacket 48 provides a flow passage 50 for engine coolant to flow along a perimeter of pump housing 40 such that heat generated by pump unit 46 is removed from the power steering pump 16 through the engine coolant system.

In a preferred embodiment, engine coolant is provided to pump housing 40 and coolant jacket 48 via boss 52, and is discharged from the coolant jacket through boss 54. The engine coolant flow direction through coolant jacket 48 can also be reversed, having inlet flow through boss 54 and exit flow through boss 52. In the exemplary embodiment of the pump housing 40 shown in FIG. 3, a housing flange 56 having a plurality of fastener apertures 58 through a face of the flange is shown. Housing flange 56 provides for mounting of the power steering pump 16 to the vehicle via fasteners (not shown) through a plurality of designated mounting apertures 60.

The power steering pump 16 is assembled and a water-tight seal is provided for flow passage 50 by assembling pump housing 40 using fasteners (not shown) connected to fastener apertures 58 through gasket apertures 62 and end cover apertures 64, which are coaxially aligned. Gasket 42 is pressed by end cover 44 to provide a water-tight seal against pump housing face 66 and coolant jacket face 68 of pump housing 40.

Figure 4:
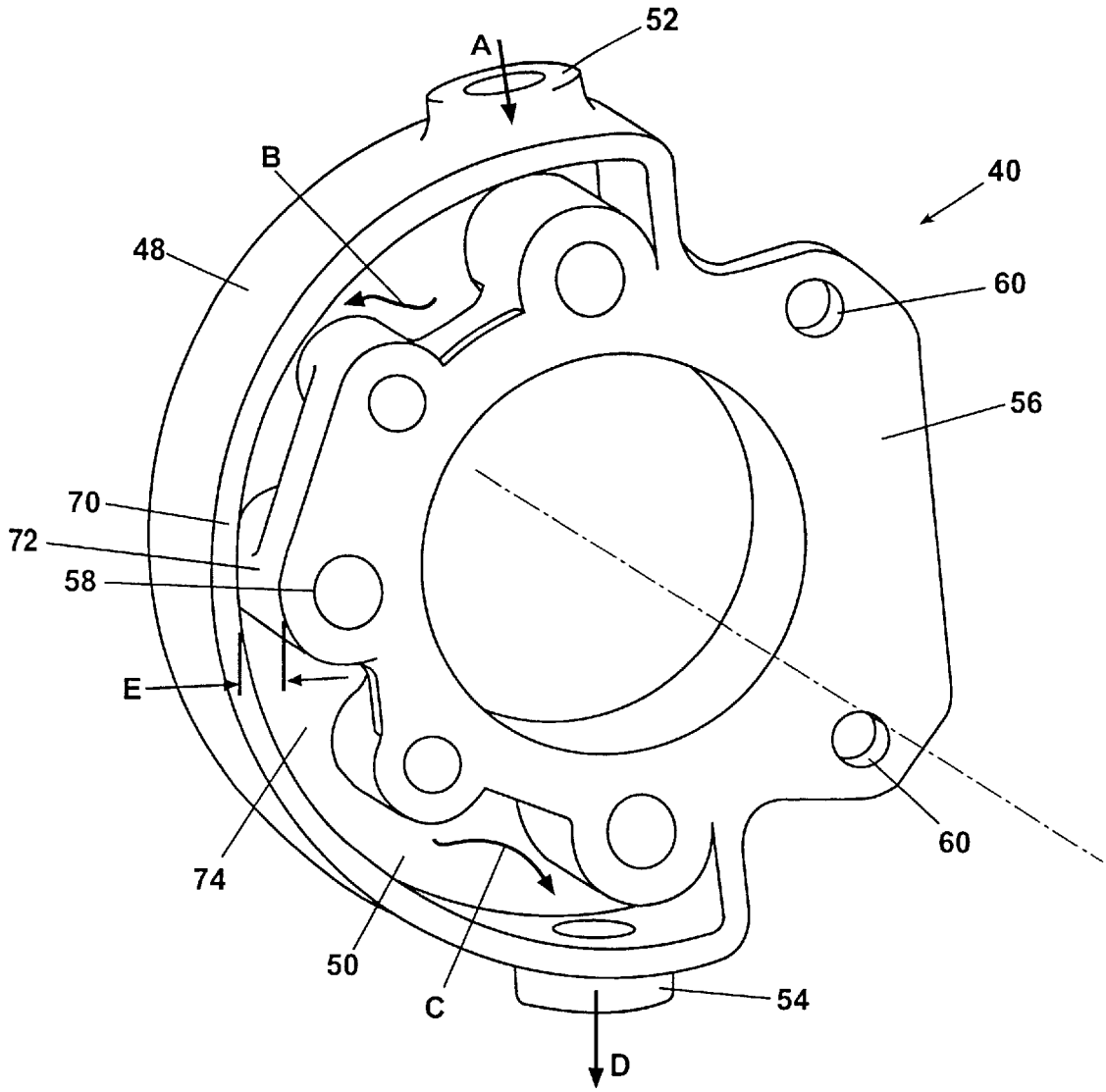
FIG. 4 is a perspective view of a portion of an exemplary power steering pump having a cast cooling jacket of the present invention.

Referring now to FIG. 4, a perspective view of one embodiment for pump housing 40 of the present invention is shown in greater detail. Coolant jacket 48 and flow passage 50 provide the flow path for engine coolant to remove heat from the power steering pump 16. Engine coolant enters pump housing 40 at boss 52 in flow direction A as shown. Engine coolant traverses coolant jacket 48 via coolant flow path B and coolant exit path C as shown. A flow clearance designated as E provides the minimum path clearance for engine coolant flow through coolant jacket 48. In a preferred embodiment of the invention, flow clearance E is about 0.6 centimeters (0.25 inches). Flow clearance E is shown between coolant jacket wall 70 and pump housing wall 72 respectively. Pump housing end wall 74 provides the engine coolant boundary for pump housing 40. Engine coolant exiting pump housing 40 via coolant exit path C is through boss 54 in coolant exit direction D as shown. In one embodiment of the invention, boss 52 and boss 54 will be provided with pipe hose fittings that are threaded for about one-half inch hose thread size. In an embodiment of the invention, female threads are provided for both boss 52 and boss 54 to mate with corresponding male threads of the system hoses (not shown).

The power steering pump 16 of the present invention provides several advantages. By using engine coolant, the air-cooled heat exchanger normally provided to cool power steering pump fluid can be eliminated. By casting the coolant jacket 48 on the pump housing 40 at the time of construction of the pump 16, the quantity of components required to apply engine coolant for the cooling supply to the power steering pump 16 are reduced. Using engine coolant to cool the power steering pump 16 provides coolant flow at a controlled range of temperature useful for both warm and cold weather driving conditions. In warm weather, the continuously flowing, continuously cooled engine coolant provides cooling for the power steering pump for all vehicle operating conditions. For cold weather operating conditions, the warmer engine coolant will decrease the viscosity of the power steering pump fluid. Reducing pump fluid viscosity reduces high frequency noise often generated by a power steering pump 16. Also, controlling pump fluid viscosity by providing a steady coolant temperature for all driving conditions will reduce wear on pump components from temperature extremes.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A motor vehicle cooling system using engine coolant as a heat-transfer medium, the system comprising:

an engine;

a radiator in fluid communication with said engine via a coolant return line, said radiator cooling an engine coolant prior to return of the engine coolant to said engine through said coolant return line;

a fluid pump in fluid communication with said radiator and pumping the engine coolant from said radiator to said engine;

a power steering pump including a pump housing and a cooling jacket, said cooling jacket disposed adjacent said pump housing and in fluid communication with said coolant return line to provide the engine coolant to said power steering pump, the engine coolant flowing between said cooling jacket and said pump housing to cool said power steering pump.

2. The cooling system of claim 1 wherein said power steering pump is connected to said coolant return line in a parallel flowpath with said engine.

3. The cooling system of claim 2 wherein the engine coolant enters an inlet port of said power steering pump, flows within said cooling jacket, and exits an outlet port of said power steering pump for return to said coolant return line.

4. The cooling system of claim 3 wherein said power steering pump is in fluid communication with said coolant return line through two fluid lines connectably fastened between said coolant return line and each of said inlet port and said outlet port.

5. The cooling system of claim 4 wherein each said fluid line is connected to said coolant return line using a plurality of pipe fittings.

6. The cooling system of claim 5 wherein said pipe fittings are selected from the group consisting of tees, elbows, flow control devices, reducers, and enlargers.

7. A method to cool a power steering pump of a motor vehicle, the method comprising the steps of:

heating an engine coolant by passing said engine coolant through an engine of said motor vehicle;

pumping the engine coolant through a coolant system of a motor vehicle comprising the steps of pumping said heated engine coolant through a heat exchanger using a fluid pump and cooling said engine coolant in said heat exchanger;

disposing a power steering pump having a pump housing in fluid communication with said coolant system;

arranging a cooling jacket adjacent said pump housing;

circulating said engine coolant between said cooling jacket and said pump housing to cool said power steering pump; and returning said cooled engine coolant to said engine through a coolant return line.

8. The method of claim 7 further comprising the steps of:

disposing said power steering pump in fluid communication with said coolant return line.

* * * * *